US007472755B2

(12) United States Patent
Riggs

(10) Patent No.: US 7,472,755 B2
(45) Date of Patent: Jan. 6, 2009

(54) METHOD FOR INSPECTION AND REPAIR OF A FLEXIBLE JOINT

(76) Inventor: David C. Riggs, 101 Cedar Crest Ct., Coppell, TX (US) 75019

( * ) Notice: Subject to any disclaimer, the term of this patent is extended or adjusted under 35 U.S.C. 154(b) by 390 days.

(21) Appl. No.: 11/160,503

(22) Filed: Jun. 27, 2005

(65) Prior Publication Data

US 2005/0284638 A1 Dec. 29, 2005

Related U.S. Application Data

(60) Provisional application No. 60/583,327, filed on Jun. 28, 2004.

(51) Int. Cl.
*E21B 7/12* (2006.01)

(52) U.S. Cl. ..... 166/365; 166/359; 166/367

(58) Field of Classification Search ..... 166/367, 166/365, 359, 345, 343; 405/224.2, 224.3, 405/158, 184.1, 223
See application file for complete search history.

(56) References Cited

U.S. PATENT DOCUMENTS 3,523,578 A * 8/1970 Crain et al. ..... 166/359
3,601,187 A * 8/1971 Tidwell ..... 175/7
3,612,176 A * 10/1971 Bauer et al. ..... 166/359
4,662,785 A * 5/1987 Gibb et al. ..... 405/195.1
4,886,395 A * 12/1989 Moles et al. ..... 405/169
5,269,629 A * 12/1993 Langner ..... 405/195.1
5,657,823 A * 8/1997 Kogure et al. ..... 166/340
6,062,312 A * 5/2000 Wilkins ..... 166/340
6,213,686 B1 * 4/2001 Baugh ..... 405/166
6,367,554 B1 * 4/2002 Theiss ..... 166/365
6,386,798 B2 * 5/2002 Finn ..... 405/224.2
6,431,284 B1 * 8/2002 Finn et al. ..... 166/350
6,568,476 B1 * 5/2003 Andersen ..... 166/363
7,341,283 B2 * 3/2008 Moses et al. ..... 285/226
2001/0031174 A1 * 10/2001 Olivier et al. ..... 405/224.2
2001/0033773 A1 * 10/2001 Baugh ..... 405/166
2001/0041097 A1 * 11/2001 Finn ..... 405/224.2
2003/0019625 A1 * 1/2003 Moog ..... 166/242.6

* cited by examiner

*Primary Examiner*—Thomas A Beach
*Assistant Examiner*—Matthew R Buck
(74) *Attorney, Agent, or Firm*—Ahab S. Ayoub

(57) ABSTRACT

A method for servicing a component of a riser system, such as a flexible joint is disclosed. The riser system may be supported in a support apparatus such that the flexible joint and an adjoining section of riser are detached to allow for inspection, servicing, repair, and/or replacement of the flexible joint or various subcomponents thereof. An apparatus is also disclosed for supporting the flexible joint during servicing.

12 Claims, 6 Drawing Sheets

METHOD FOR INSPECTION AND REPAIR OF A FLEXIBLE JOINT

CROSS-REFERENCE TO RELATED APPLICATIONS

This application claims priority to U.S. Provisional Application No. 60/583,327, entitled "Method of Retrieving, Repairing, and Replacing Pipeline Risers Connected to Offshore Floating Production Systems, Tension Leg Platforms and Fixed Structures" filed Jun. 28, 2004, which is hereby incorporated by reference.

BACKGROUND OF INVENTION

1. Field of the Invention

The invention relates generally to inspection, repair, and replacement of pipeline risers, particularly components such as the flexible joints utilized therewith.

2. Background Art

Risers typically are used to connect a subsea wellhead assembly to a floating vessel. Typically, the lower end of a riser is connected to a wellhead assembly adjacent the ocean floor, and the upper end is operatively connected to the floating vessel such that a sealed connection is formed between the wellhead assembly and the floating vessel.

As production operations have progressed into deeper waters, the length of the riser also has increased. Due to the greater stresses placed upon such systems, riser structural failure may result if various stresses in the elements of the riser exceed the strength and fatigue limitations of the riser material. Flexible joints are typically used to mitigate stresses at the hang-off point while supporting the riser axial load.

As shown in FIG. 1, flexible joints 10 are typically installed as a component of the riser 11, or at the interface between the riser 11 and a floating structure or platform 13 to which the riser 11 is connected. Flexible joints 10 may comprise various configurations, including a ball joint to permit articulation of the riser 11 with respect to the floating structure 13 and may also include one or more elastomeric elements to facilitate relative motion between risers or between a riser and the operatively connected floating structure 13. Facilitation of relative movement by the elastomeric elements and other components of a flexible joint 10 effectively lessens the occurrence of damage due to the various forces and tensions occurring in the riser 11 and in the interface between riser 11 and platform 13.

FIG. 2 demonstrates one variation of an operative connection between a riser 11 and offshore platform 13. In this configuration, the flexible joint 10 is configured to operatively connect to a receptacle 14 of the offshore platform 13. At its other end, the flexible joint 10 is operatively connected to static spool piping 15 leading to the upper areas of the platform 13.

Flexible joints 10 and other components used in conjunction with offshore riser systems are often subjected to tremendous elastomeric strains and metal stresses. Over time, such strains, environmental factors, and other variables may result in damage to the flexible joints 10. Traditionally, the inspection or repair of a flexible joint 10 will involve a long period of decreased productivity during which production operations must be severely curtailed or discontinued while the riser 11 and flexible joint 10 are accessed, the flexible joint 10 is retrieved, removed from the riser 11 and a temporary workaround installed. After a separate off-site inspection and refurbishment or replacement of the flexible joint 10 is completed, the process is reversed to remove the workaround and install the replacement or refurbished flexible joint 10. The entire process will often result in a shutdown of production for many weeks, exposure of divers and other workers to dangerous conditions, and millions of dollars in lost production and productivity. Accordingly, there is a need for an improved method for inspecting, repairing, and/or replacing such flexible joints 11.

SUMMARY OF INVENTION

In one embodiment, the invention comprises a method for servicing a component of a riser system, such as a flexible joint. The riser system is supported in a support apparatus, and the flexible joint is removed and serviced. Flow through the riser system may be reestablished after or during removal of the flexible element.

In one embodiment, the invention comprises an apparatus for supporting a riser system and/or a combination flexible joint and riser top section. The apparatus may include one or more openings and/or slots for accommodating a riser and/or riser top section.

Other aspects and advantages of the invention will be apparent from the following description and the appended claims.

DETAILED DESCRIPTION

Figure 1:
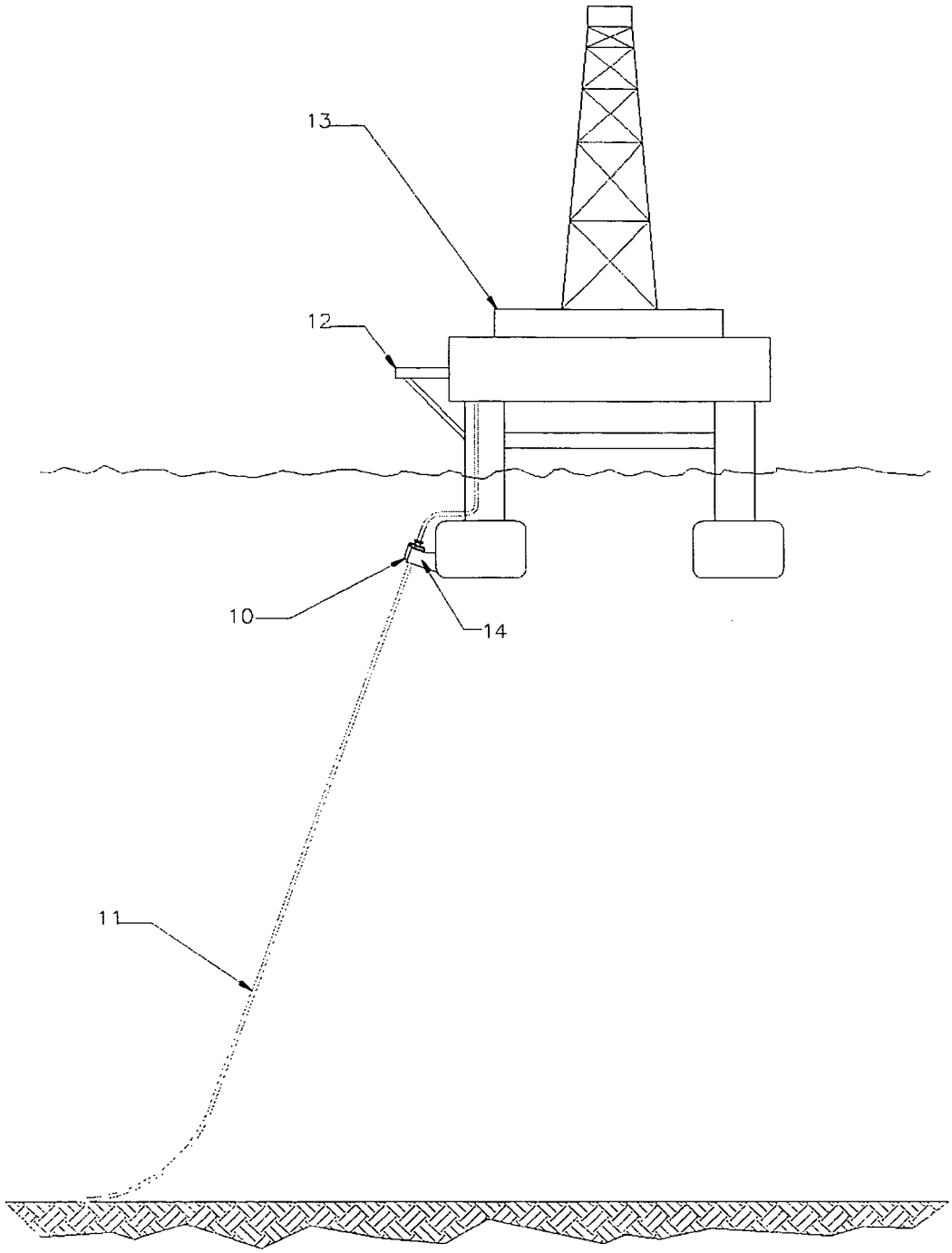
FIG. 1 shows a prior art offshore riser system.
Figure 2:
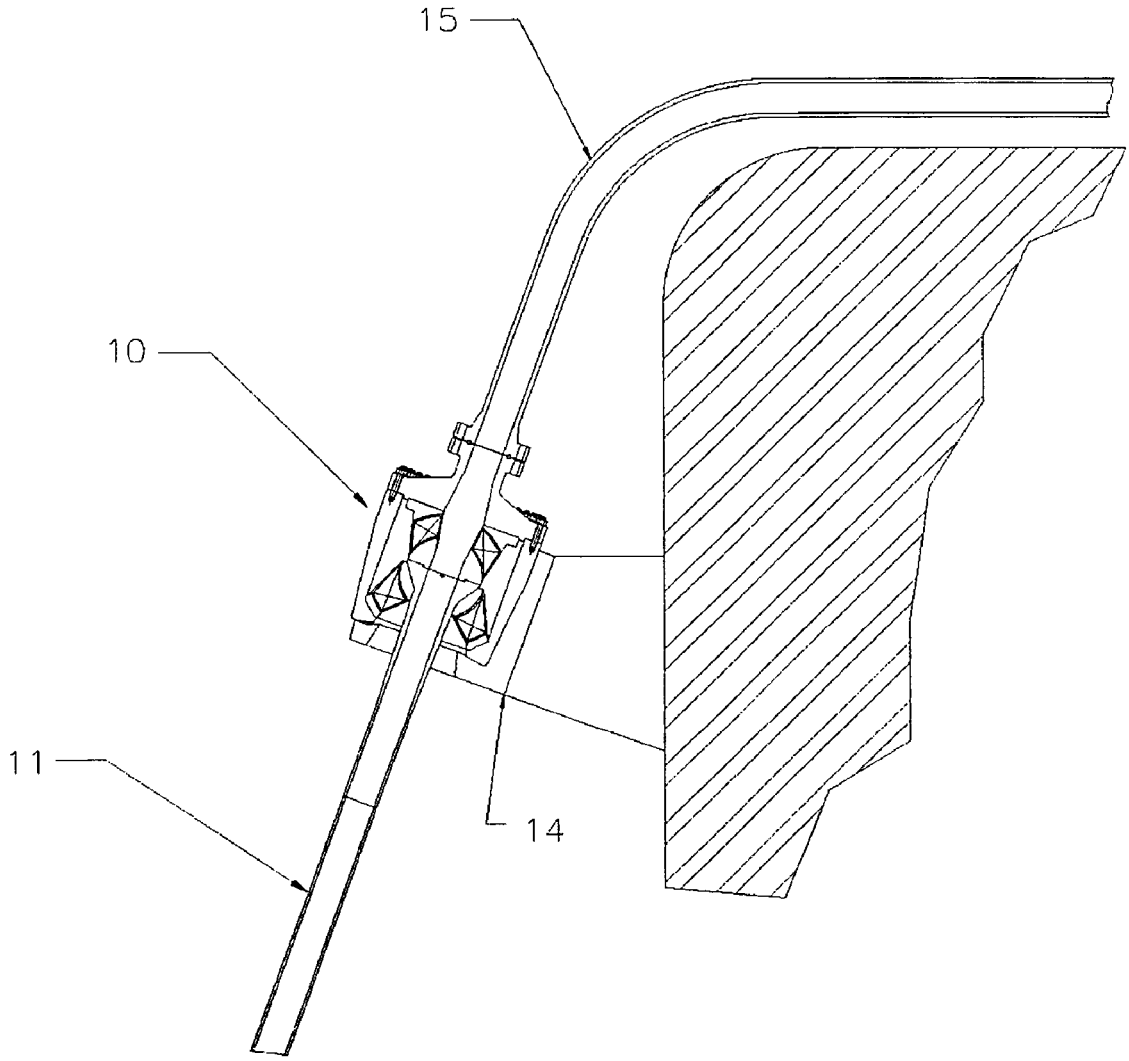
FIG. 2 shows a prior art flexible joint and receptacle.
Figure 3:
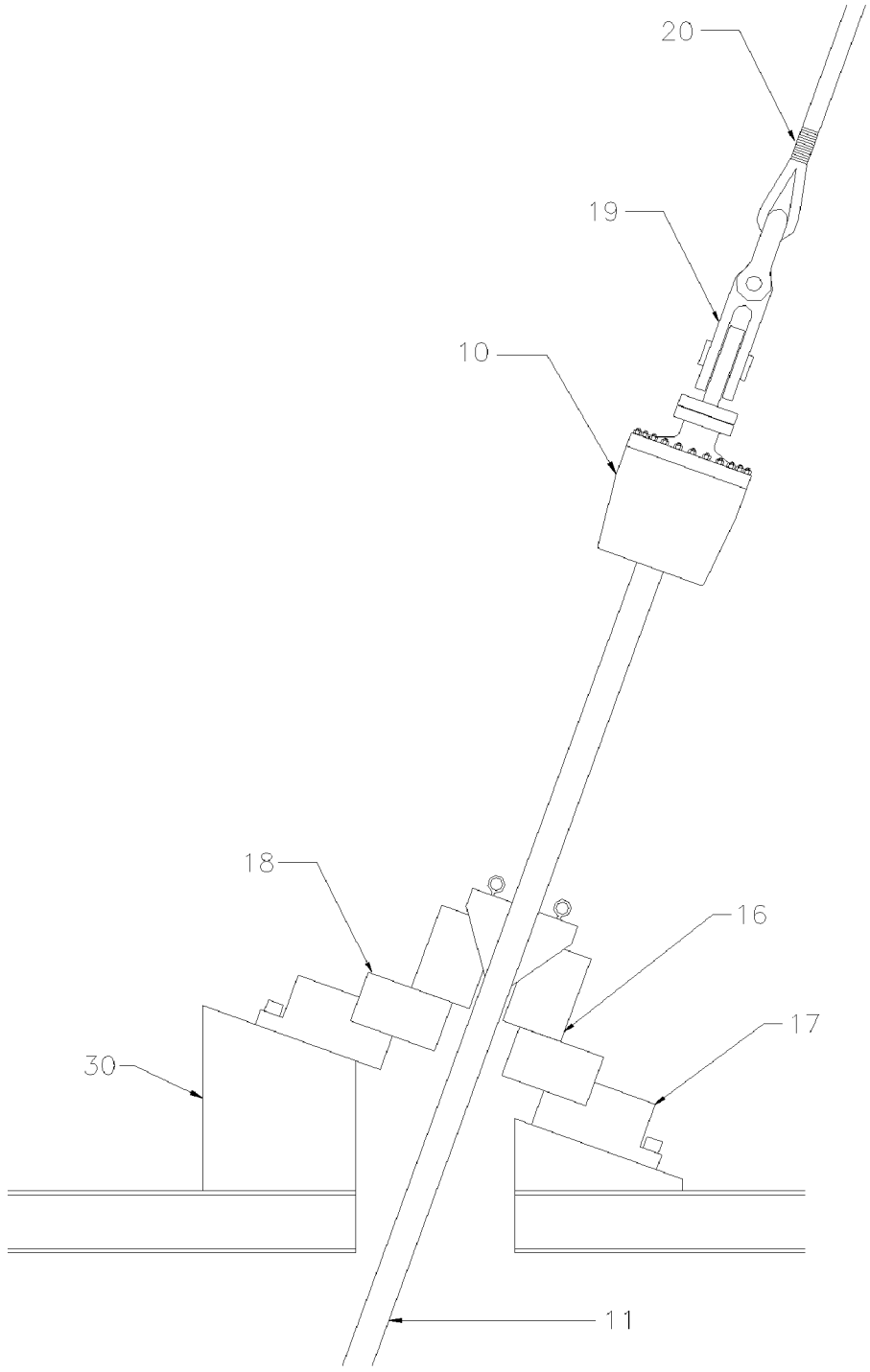
FIG. 3 shows one embodiment of a support apparatus as may be used with embodiments of the invention.

As shown in FIG. 3, in one embodiment, the invention comprises a method for the inspection, repair, and/or replacement (also collectively referred to herein as "servicing") of a component of a riser system, such as a flexible joint 10. The method comprises the operative connection of a winch or similar device 20 to the flexible joint 10. The operative connection between winch 20 and flexible joint 10 may comprise an abandonment and recovery head 19. The winch 20 raises and/or otherwise moves the flexible joint 10 such that a riser 11 operatively connected thereto is positioned such that a support apparatus 30 is able to operatively connect to and provide support for the riser 11.

In one embodiment, the support apparatus 30 comprises slips 16 for operatively connecting to the riser 11. The slips 16 may be supported by one or more split bushings 19 and/or a gimbal table 17. Other embodiments of an apparatus for supporting a riser 11 operatively connected to a flexible joint 10 may also be used with the methods described herein.

Figure 4:
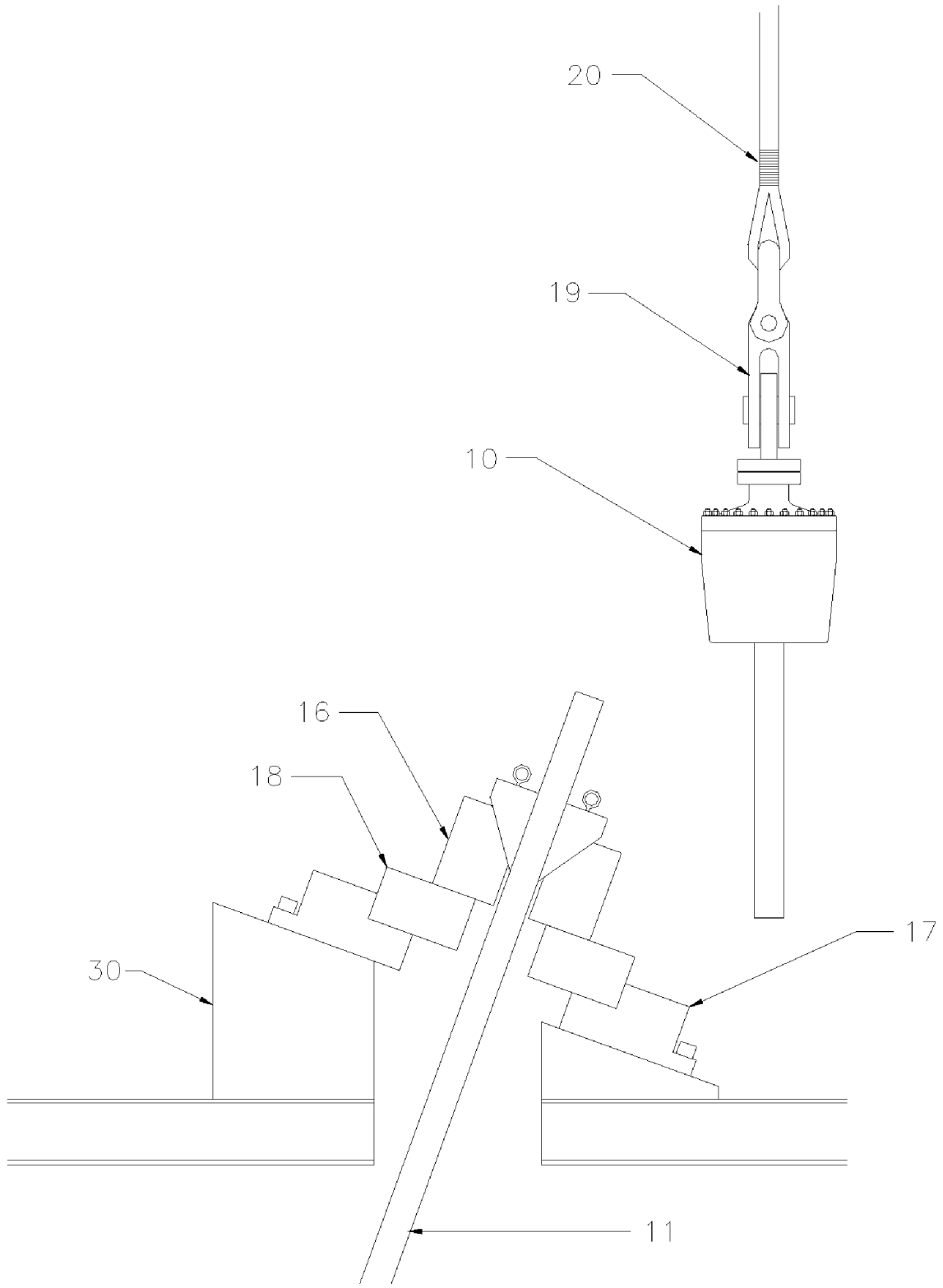
FIG. 4 shows a flexible joint separated from a riser according to one embodiment of the invention.

As shown in FIG. 4, in one embodiment, once the riser 11 is supported by the support apparatus 30, the flexible joint 10 is disconnected from the riser 11. The disconnection may occur at the flexible joint 10, the interface between flexible joint 10 and riser 11, or at any point along the riser 11. Once disconnected the flexible joint 10 may be moved to a convenient location for examination, repair, and/or replacement while the riser 11 will remain suspended in the support apparatus 30.

In one embodiment, after the flexible joint 10 has been disconnected from the riser 11, or during disconnection, a fluid connection is established between the riser 11 and piping such as 15 such that flow may continue through the riser system 11 while the flexible joint 10 is detached. The fluid connection may comprise flexible piping, steel piping with expansion or flexible joints, or any other mechanism known in the art for establishing and/or maintaining flow between two tubular members.

In one embodiment, the flexible joint 10 and riser top section 31 (see FIG. 5) operatively connected thereto will be supported by a second support apparatus 30 or similar device to facilitate the disassembly of the flexible joint 10 and removal of the operatively connected riser top section 31. In one embodiment, such a support apparatus 30 will include a central opening or side slot such that the riser top section 31 operatively connected to the flexible joint 10 may be lowered through the opening or translated through the side slot and lowered until the flexible joint 10 is directly supported by the support apparatus 30. In one embodiment, such lowering will continue until the flexible joint 10 is disposed in a receptacle of the support apparatus 30.

In one embodiment, the flexible joint 10 and riser top section 31 may be supported within a support apparatus 30 configured to support both the lower section of riser 11 and the riser top section 31 and flexible joint 10. Such a support apparatus 30 may include a second passage therethrough for passage of a portion of the riser top section 31 and a section configured to cradle the flexible joint 10.

Figure 5:
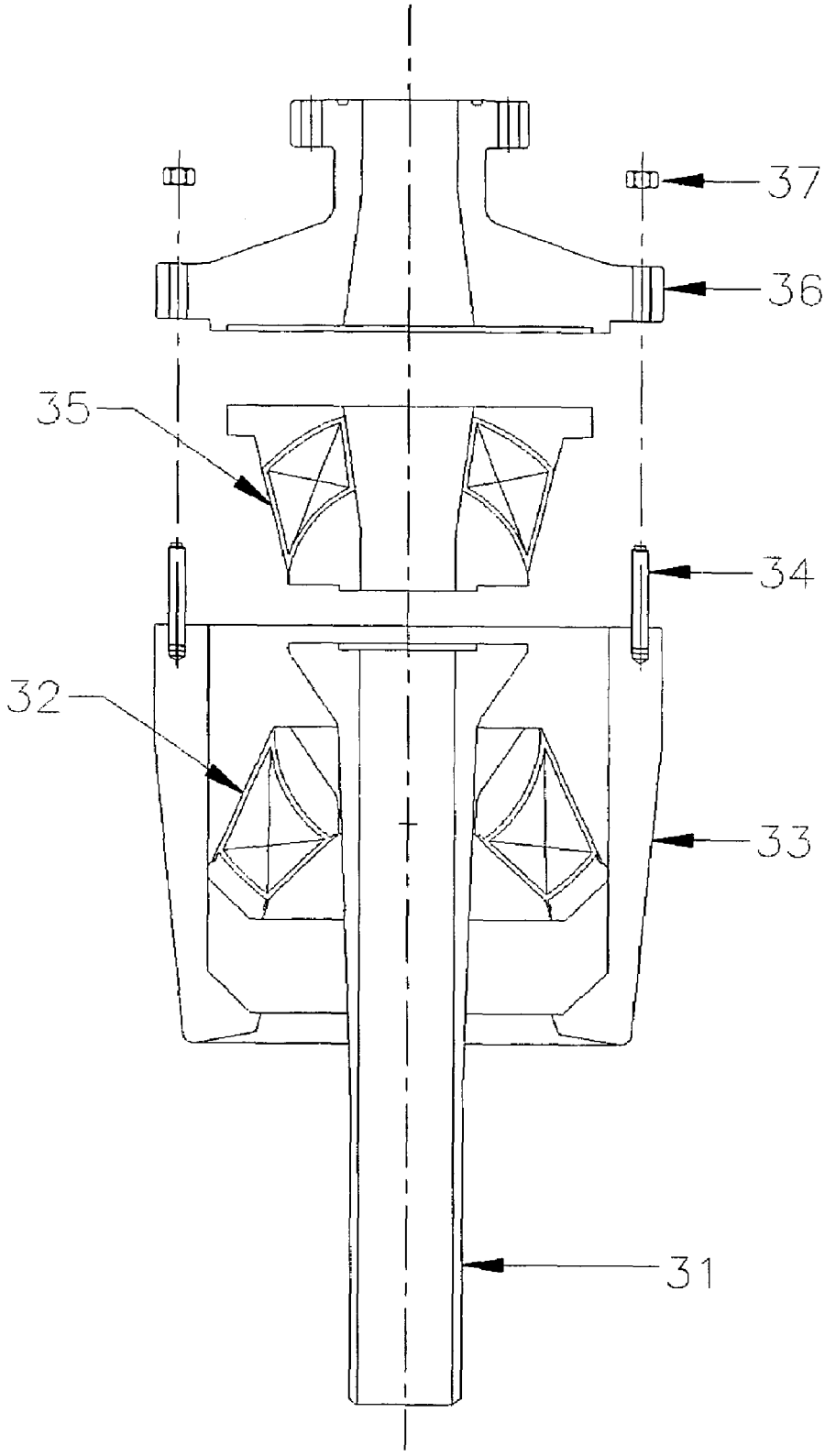
FIG. 5 shows the components of one embodiment of a flexible joint as may be used with embodiments of the invention.

As shown in FIG. 5, in one embodiment the method comprises disassembly of a flexible joint 10. One or more separable flexible elements 32, 35 may be detached from one or more other elements of the flexible joint 10. The order of disassembly may vary and in one embodiment will involve the removal of one or more nuts 37 or similar elements from operatively connected studs 34 allowing for the lifting and/or separation of the top flange 36 from the flexible joint body 33. Once the flexible joint 10 is disassembled to a desired degree, the various elements thereof may be separately inspected and/or replaced.

The steps required for disassembly may vary with various configurations of flexible joints 10 and no particular configuration of a flexible joint 10 is intended to be a limitation on embodiments of the invention. Reassembly may occur through reversal of the disassembly process.

In one embodiment, where the flexible joint 10 is supported in a support apparatus 30, the method of disassembly may comprise the removal of one or more nuts 37 allowing for the separation of the top flange 36 from the flexible joint body 33 which will remain supported in the support apparatus 30. The support provided by the support apparatus 30 advantageously facilitates inspection and disassembly of the remaining elements of the flexible joint 10, including the removal of flexible element 35, pipeline riser top section 31, flexible element 32 and/or any other elements of the flexible joint 10. This approach advantageously facilitates the inspection, repair, and/or replacement of the riser top section 31 as well.

Figure 6:
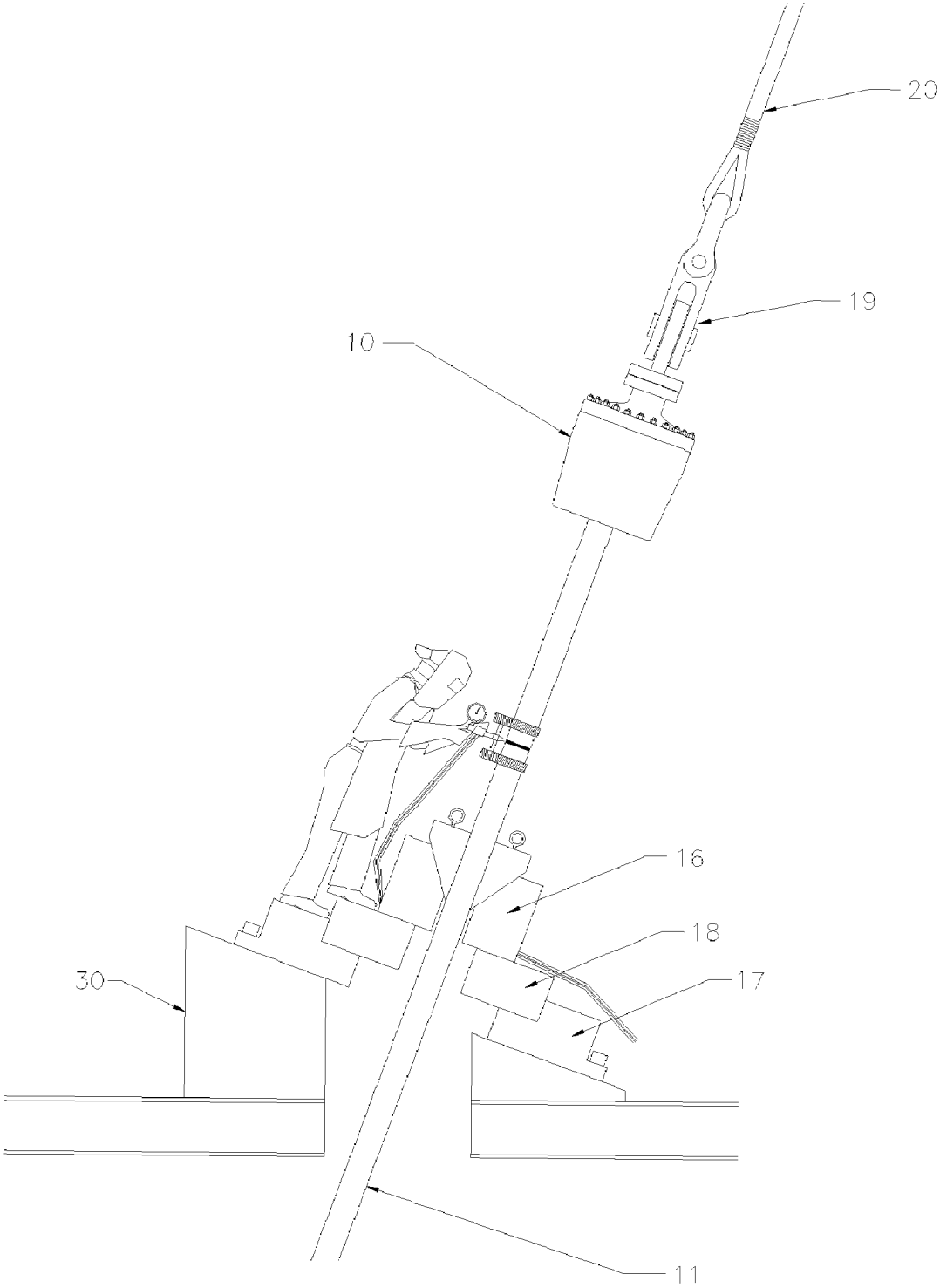
FIG. 6 shows the reconnection of a flexible joint and riser according to one embodiment of the invention.

Once the desired elements are inspected and/or replaced, the flexible joint 10 is then reassembled and operatively connected to the riser 11 as shown in the embodiment of FIG. 6. Reconnection of the flexible joint 10 and riser 11 may occur by welding and/or mechanical connectors and/or any other mechanism known in the art. Upon reconnection, it may be desirable to test the flexible joint 10, and/or its connection with the riser 11. Once the flexible joint 10 has been reconnected to the riser 11, the flexible joint 10 and riser 11 may be returned to their operational location.

Flex elements such as those shown at 32, 35 may be configured to be used with different sizes and/or configurations of flexible joints 10. Furthermore, flex elements, and other elements of a flexible joint may be standardized such that various standard sizes may be stocked for use with a number of flexible joints 10, possibly located in different locations. Such standardization of flex elements and other subcomponents advantageously allows for the stocking of a limited number of such parts for use in servicing of flexible joints 10. Flex elements may also be configured such that certain predetermined combinations thereof may be utilized with specific sizes and/or configurations of flexible joints 10 and may further be combined to provide varying degrees of flexibility or other attributes as needed. Flexible joints 10 may also be configured to accommodate different sizes and/or configurations of flex elements. For instance, the size of a body of a flexible joint 10 may be standardized based on a desired type and/or size of flex element which an operator may desire to use therewith.

The descriptions and illustrations of flexible joints 10 herein are representative and not intended to limit the scope of the various embodiment of the invention. For instance, the flexible joint 10 need not comprise a flange 36 and the operative connection of the flexible joint 10 and winch 20 or similar apparatus may be of any type known in the art and may vary with various configurations of flexible joints 10. Furthermore, the various components described herein may be of any type and comprise any materials or combination thereof known in the art.

Embodiments described herein advantageously permit the inspection, repair and/or replacement of various elements of a flexible joint in a manner that lessens interruption of production, danger to workers, and expense. For instance, the ability to repair and/or replace individual components of a flexible joint 10 lessens the cost of repair while minimizing downtime by allowing for the stocking of individual components, such as flexible elements, that may be expected to require replacement. The ability to separately inspect, repair, and replace the individual elements of a flexible joint 10 advantageously allows for the replacement of individual elements in lieu of replacing an entire flexible joint 10. Furthermore, various embodiments described herein advantageously permit the inspection, repair, and or replacement of flexible joints 10 and various elements thereof using tools and equipment traditionally found on an offshore platform, and the ability to perform such servicing on location.

Embodiments described herein advantageously permit the design and use of interchangeable flexible elements that are usable with a variety of riser configurations, loads, and sizes. The use of interchangeable flexible elements advantageously permits the creation of a stock of such elements for use in multiple offshore facilities as needed.

Embodiments of the invention described herein may also be used to inspect, repair and/or replace one or more other components of a riser system, including tubular members, other joints, and any other components known to one skilled in the art. Embodiments may be used with flexible joints 10 that are submerged when deployed, as well as those that are disposed above the waterline when deployed. Embodiments may also be used with any system which utilizes suspended tubular members, including but not limited to flexible composite risers, rigid steel risers, control umbilicals, bundled pipeline risers, and hybrid combinations.

The terms "riser" and "riser system" are used interchangeably herein to mean any system that utilizes suspended tubular members. These terms may also have any other meaning known to one skilled in the art in accordance with the spirit of the invention as described in the various embodiments herein.

The various parts of a flexible joint 10 have been interchangeably described herein as "subcomponents" and "elements" of a flexible joint 10. The use of such terminology is not intended as a limitation on those parts and is merely a generic reference to the separate or separable parts of the flexible joint 10.

A support apparatus as described herein may be of any type known in the art, including, but not limited to a gimbal table. Any number of support apparatuses may be used with the methods disclosed herein. The support apparatus may be disposed in any desired location on a platform or vessel. In one embodiment, the support apparatus may be operatively connected to the periphery of a platform or vessel.

Movement of a riser 11 and/or various components thereof may be accomplished by any mechanism known in the art including, but not limited to, a winch, a crane, pulleys and combinations thereof. Furthermore, the operative connection between the component and the mechanism for moving the component may be of any type known in the art, including but not limited to an abandonment and recovery head. Furthermore, the operative connection between the target component and the mechanism for moving the component need not be direct. For example, in one embodiment a winch or similar device may connect at a point above a flexible joint (target component) such that the flexible joint may be moved from a first position to a second position.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for servicing a flexible joint operatively connected to a riser system, comprising:

moving the flexible joint from a first position to a second position;

at least partially disassembling the flexible joint; and servicing at least one separable flexible element of the flexible joint, wherein the servicing comprises at least one selected from inspecting, repairing, and replacing, the at least one separable flexible element.

2. The method of claim 1, further comprising disconnecting the flexible joint from at least a portion of the riser system prior to servicing the at least one separable flexible element.

3. The method of claim 2, further comprising supporting the portion of the riser system in a support apparatus prior to disconnecting the flexible joint.

4. The method of claim 3, wherein the support apparatus comprises a gimbal table.

5. The method of claim 3, further comprising fluidly connecting the portion of the riser system to piping such that flow through the riser system may occur during servicing.

6. The method of claim 1, further comprising returning the flexible joint to the first position.

7. The method of claim 1, wherein the moving is performed by a winch.

8. The method of claim 7, wherein the winch is operatively connected to the flexible joint using an abandonment and recovery head.

9. The method of claim 1, wherein the second position is an operative connection to a support apparatus.

10. The method of claim 9, wherein the support apparatus comprises a gimbal table.

11. The method of claim 10, wherein the support apparatus is configured to separately support both the flexible joint and the riser system.

12. The method of claim 1, wherein the at least partially disassembling comprises removing the at least one separable flexible element from the flexible joint.

* * * * *